US005213841A

United States Patent [19]

Gulla et al.

[11] Patent Number: 5,213,841

[45] Date of Patent: May 25, 1993

[54] METAL ACCELERATOR

[75] Inventors: Michael Gulla; Prasit Sricharoenchaikit, both of Millis, Mass.

[73] Assignee: Shipley Company Inc., Newton, Mass.

[21] Appl. No.: 523,713

[22] Filed: May 15, 1990

[51] Int. Cl.[5] ..... C23C 26/00

[52] U.S. Cl. ..... 427/98; 427/96; 427/304; 427/305; 205/167; 205/187; 205/210

[58] Field of Search ..... 427/96, 98, 306, 305, 427/304; 205/167, 187, 210

[56] References Cited

U.S. PATENT DOCUMENTS

| | | | |
|---|---|---|---|
| Re. 29,015 | 10/1976 | De Angelo | 427/98 |
| 3,011,920 | 6/1959 | Shipley, Jr. . | |
| 3,817,774 | 6/1974 | Kuzmik | 427/304 |
| 3,874,882 | 4/1975 | Gulla | 427/304 |
| 3,904,792 | 9/1975 | Gulla et al. . | |
| 3,962,497 | 6/1976 | Doty | 427/306 |
| 4,035,227 | 7/1977 | Doty | 427/307 |
| 4,229,218 | 10/1980 | Gulla | 106/1.26 |
| 4,525,390 | 6/1985 | Alpaugh | 427/305 |
| 4,639,380 | 1/1987 | Amelio | 427/305 |
| 4,725,314 | 2/1988 | Gulla | 427/443.1 |
| 4,863,758 | 9/1989 | Rhodenizer | 427/304 |
| 4,895,739 | 1/1990 | Bladon | 427/96 |
| 4,931,148 | 6/1990 | Kukauskis | 427/98 |

*Primary Examiner*—Shrive Beck
*Assistant Examiner*—Vi Duong Dang
*Attorney, Agent, or Firm*—Robert L. Goldberg

[57] ABSTRACT

A process for metal plating characterized by use of an accelerator solution of a metal reducible by stannous tin between a step of catalysis and metal deposition.

30 Claims, 3 Drawing Sheets

METAL ACCELERATOR

BACKGROUND OF THE INVENTION

1. Introduction

This invention relates to a step of catalysis in a process for metal deposition and more particularly, to an improved accelerator composition for use in combination with a tin containing electroless metal plating catalyst for improved deposition properties.

2. Description of the Prior Art

Metal deposition over a substrate may be by electroless deposition, electrolytic deposition or a combination of the two. Electroless deposition is the chemical deposition of a metal or mixture of metals over a catalytic surface by chemical reduction and processes for electroless metal deposition are disclosed in U.S. Pat. Nos. 2,702,253 and 3,011,920 incorporated herein by reference. If the substrate to be metal plated is inert—i.e., not catalytic to metal deposition, the conventional process of plating comprises pretreatment to promote cleanliness and adhesion, catalysis of the substrate prior to deposition by treatment with a suitable plating catalyst that renders the surface catalytic to electroless metal deposition followed by a step identified by the art as acceleration. Plating catalysts are disclosed in the aforesaid patents.

Electrolytic deposition is the deposition of a metal over an electrically conductive substrate where a part to be plated serves as one of the electrodes in an electrolytic cell. A recent process for electrolytic deposition of a non conducting substrate is disclosed in U.S. Pat. Nos. 3,099,608 and 4,895,739, both incorporated herein by reference wherein an inert substrate is made sufficiently conductive for direct electroplating by a process using the same type of plating catalyst as the electroless plating process described above. Following catalysis with a catalyst of the type disclosed in the aforesaid U.S. Pat. No. 3,011,920, a part is treated with an accelerator and electrolytically plated without an intermediate electroless plating step.

The catalyst most in commercial use for each of the above electroless and electrolytic plating processes comprises the reaction product of a substantial molar excess of stannous tin with palladium ions in hydrochloric acid solution. The reaction product is believed to be a tin palladium colloid. It is believed that the oxidized stannic tin in combination with unreacted stannous tin and palladium ions form a protective, possibly polymeric, complex for the palladium or palladium-tin alloy while the unreacted stannous ions act as an antioxidant. Colloidal tin-palladium catalysts were first described in U.S. Pat. No. 3,011,920 incorporated herein by reference.

An improvement in colloidal tin palladium catalysis is disclosed in U.S. Pat. No. 3,904,792 incorporated herein by reference. In this patent, to provide a catalyst that is less acidic than those disclosed in the aforesaid U.S. Pat. No. 3,011,920, a portion of the hydrochloric acid is replaced by a solution soluble metal halide salt of the acid resulting in a more stable catalyst having a pH that can approach about 3.5. The catalysts of this patent are in significant commercial use.

It is known in the art that in use of a catalyst formed from the reaction product of stannous tin and noble metal ions, a process sequence would typically include the steps of catalysis of the substrate, acceleration of the catalytic layer, typically with an acid such as fluroboric or perchloric acid and electroless or electrolytic metal deposition. The step of acceleration is known to activate the palladium catalyst, enhance the initiation of the plating reaction and decrease the plating time for total coverage of the part to be plated. Though much has been written about the step of acceleration, the function of the accelerator is still not fully understood. The prevailing explanation in the art is that the accelerator dissolves both unreacted stannous salt and stannic acid surrounding the catalytic noble metal particle adsorbed onto the surface of the part to be plated thus exposing them and permitting the noble metal to function as a catalyst. A lessor known but plausible theory is that the acid environment causes autoreduction of a tin noble metal complex surrounding the noble metal particle on the surface of the part to be plated. Regardless of the theory, it is known that the step of acceleration significantly improves the efficiency of the plating reaction and the quality of the metal deposit.

SUMMARY OF THE INVENTION

In accordance with the invention disclosed herein, a metal plating process comprises the steps of catalysis with a tin-noble metal catalyst, acceleration and electroless metal plating, electrolytic metal plating or electroless plating followed by electrolytic plating, the same steps as employed in the prior art. However, in the process of this invention, the accelerator used comprises an ionic, preferably aqueous solution of a metal reducible by stannous ions rather than an acidic or basic solution as in the prior art. The metal reducible by stannous ions is preferably a metal catalytic to electroless metal deposition and most preferably palladium or the same metal as the metal of the catalyst or electroless plating solution.

Without wishing to be bound by theory, following the step of catalysis, the catalyst remaining on the surface of the part to be plated contains significant amount of adsorbed stannous ions which are present due to their excess in solution and which are believed to comprise in part, a portion of a complex stannous-halogen-noble metal complex. By treatment with a metal solution containing a reducible metal, it is believed that the stannous tin results in the reduction of the metal of the accelerator solution by the tin creating additional catalytic sites while simultaneously eliminating non-catalytic complex and/or free excess stannous ions on the surface of the part to be plated. This is believed to result in an increase in the density of catalytic sites over the part to be plated. For this reason, the catalyzed surface is more active with the initiation time for the plating reaction to begin and the time for complete coverage reduced. Moreover, it is an unexpected discovery of this invention that in addition to enhanced catalytic activity, metal deposited during the deposition reaction is finer grained and where selective metallization is desired, such as in the fabrication of printed circuit boards or semiconductor devices, line edge acuity is improved. This is a particular advantage in processes that metallize microlithographically generated images or procedures involving the metallizing of ultrafine structures such as fine particles or tubules. Finally, adhesion of a metal deposit to a substrate is improved using a process employing the accelerator of this invention as shown by a decrease in defects such as micro blisters, voids or lift off from a pattern.

DESCRIPTION OF THE PREFERRED EMBODIMENTS

Figure 1:
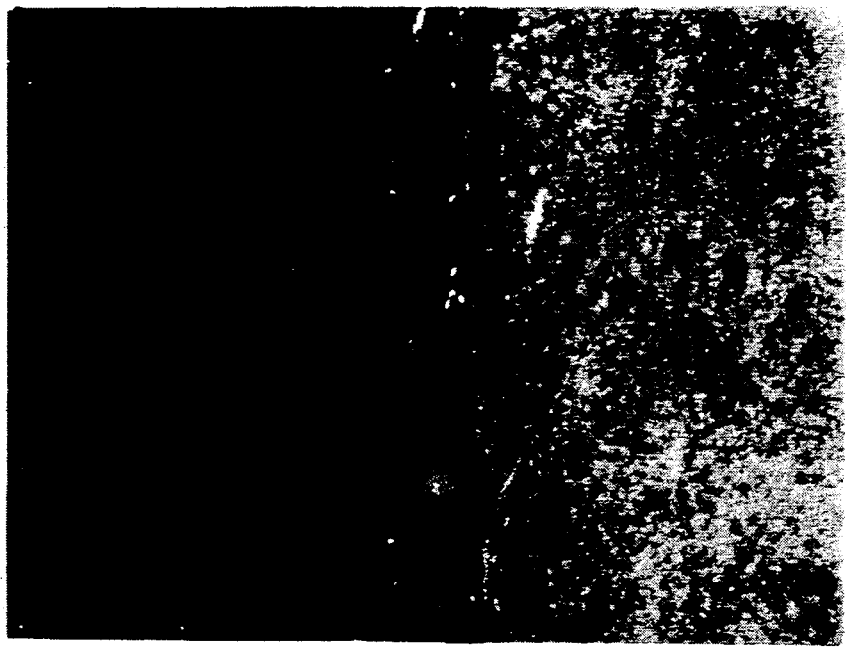
FIG. 1 is a photograph at a 40 magnification showing a nickel deposit obtained using the process of the invention compared to a process of the prior art.

The catalyst used in conjunction with the accelerators of this invention are formulated substantially with materials and in proportions such as those described and claimed in U.S. Pat. No. 3,011,920 referenced above. With respect to the catalyst of U.S. Pat. No. 3,011,920, the acid soluble salt of the catalytic metal is a salt of any of those metals known to exhibit catalytic properties in chemical plating. Such metals include primarily the precious metals, gold and silver, members of the platinum family and mixtures of such metals. Palladium is generally found to be the most satisfactory of these catalytic materials for the catalysis of a nonconducting substrate, particularly a plastic or other inert substrate and therefore constitutes the preferred embodiment of this invention. Silver, gold and rhodium constitute lesser preferred embodiments of the invention as some difficulty is encountered in the preparation of the catalyst due to limited solubility of the salts of these metals in solution and limited catalytic activity of catalysts formed from these metals.

The particular salt of the catalytic metal used is not critical provided a complex is formed. Complexes are most readily formed using halide salts and halides salts such as those described in the aforesaid U.S. Pat. No. 3,011,920 are preferred, chlorides being most preferred. Salts other than halides are also suitable, especially if halide ions are introduced into solution by an extraneous source of halide ions. In this instance, a salt of a halide is used having an anion common to that of the other catalyst components.

The amount of the catalytic metal salt is not critical in the formation of prior art catalysts and is primarily governed by cost and functional considerations and by a required ratio of tin to the catalytic metal. Thus, though up to five grams per liter or more of the catalytic metal salt is possible, it is desirable to maintain the quantity of the catalytic metal salt as low as possible from a cost consideration without sacrificing the functional properties of the catalytic formulation. This is especially true when the catalyst is used in a process for metallizing microlithographic generated images. A reduced concentration of catalytic metal is also highly desirable because the largest loss of catalyst in the plating reaction is due to drag out from the catalyst solution during the plating sequence. Consequently, the lower the concentration of the catalytic metal in the catalyst treatment solution, the lower will be the lost of expensive catalytic metal by drag-out.

Typically, the amount of the catalytic metal salt in a ready for use catalyst bath does not exceed two grams per liter of solution and more preferably, ranges between about 0.1 and 1 gram per liter of solution. When using the accelerators of this invention, lower concentrations of the catalytic metal are possible due to enhancement of catalytic activity with the accelerator of the invention. Most preferably, the catalyst have higher than conventional tin to catalytic metal contents.

The stannous salt used to formulate a catalyst is likewise not critical and in addition to stannous halide, other stannous salts are suitable such as stannous sulphate. As with the salt of the catalytic metal, the stannous halide having an anion common to that of other catalyst constituents is preferred. The amount of stannous salt is not critical provided stannous ions are present in the catalyst formulation in substantial molar excess of the catalytic metal ions. In this respect, the molar ratio of the stannous ion to the catalytic metal ion may be as low as 2:1, but preferably varies between 10:1 and 40:1 and maybe as high as 100:1 or more.

Hydrohalide acids, other than hydriodic acid and hydrofluoric acid, are preferred for preparation of a plating catalyst. However, results in terms of stability and catalytic activity with hydrofluoric acid are marginal. Hydrobromic acid is better and hydrochloric acid provides the best results. Accordingly, the term hydrohalide acid as used is meant to mean principally hydrochloric acid and mixtures of hydrochloric acid With other acids, but also includes hydrohalide acids other than hydriodic acid and hydrofluoric acid with the realization that these other acids provide marginal results.

The amount of acid used is preferably an amount capable of providing a pH not exceeding 3.5 if an extraneous source of halide ions is used in addition to the hydrohalide acid and not exceeding 1.0 in the absence of such an extraneous source of halide ions. If an additional source of halide ions is not used, the pH of the catalyst should read 0 (1 Normal) when measured.

To prepare a catalyst, the salts of the noble metal and stannous ion in stoichiometric excess are mixed in acid solution, heated and permitted to react with time. Procedures for the formation of such catalysts are well known in the art.

The accelerator solution of this invention is an ionic solution of a metal reducible by stannous tin which is not detrimental to the catalytic plating reaction. The ionic solution may be of an ion that is a complex such as a chloro complex of the metal. Preferably, the ionic solution is an aqueous solution but other ionic solutions such as non aqueous alcohol solutions may be used. The method by which the process of the invention operates is not fully understood. In this respect, reference is made throughout this specification to use of a metal reducible by tin as this is the most likely explanation of the manner in which enhanced acceleration occurs. However, this should not be construed as a requirement that the metal ions contained within the accelerator are reduced to metal. Reduction may be to a lower valence state, but not to metallic form. Moreover, it is possible that the stannous tin and the metal within the accelerator form a complex that enhances metal deposition, especially when in contact with a reducing agent from an electroless plating solution.

Metals reducible by tin are those that are more noble (cathodic) in the electromotive series than tin and include copper, nickel, silver, platinum, palladium, gold, etc. Metals known to be detrimental to the plating reaction include those disclosed in U.S. Pat. No. 3,310,430 incorporated herein by reference and are believed to include, for example, vanadium, molybdenum, niobium, tungsten, arsenic, antimony, bismuth, actinium, lanthanum, and rare earths of both the lanthanum and actinium series.

The accelerators of the invention are made by dissolving a solution soluble salt of the metal reducible by stannous tin in an aqueous solution that may vary in pH from alkaline to acidic, dependent upon the solubility characteristics of the accelerator salt and its reduction potential, but which is preferably acidic and most preferably, a hydrochloric acid solution. Most preferred are hydrochloric acid solutions of noble metals, especially palladium chloride solutions or solutions of a metallic salt that is the same metal as the catalytic metal used in the step of catalysis of the substrate to be plated. For example, if the catalyst is a tin-palladium catalyst, the accelerating solution is preferably an acidic solution of palladium chloride which most preferably is present in solution as a chloro-palladous complex. If an alkaline solution is used, the solution may require a complexing agent to prevent formation of an insoluble hydroxide of the metal.

The pH of the accelerator solution of the invention is dependent upon the metal salt used to form the accelerator. In all cases, the pH must be lower than the pH at which an insoluble hydroxide of the metal would form in the absence of a solubilizing agent. As is known in the art, hydroxide formation is dependent upon concentration of the salt in solution and pH. Simple alkali or alkaline earth metal halides require an acidic solution preferably having a pH not exceeding 1 to avoid hydroxide formation. For manufacture of articles having metal surfaces such as copper, it is desirable to use a weak acid solution to avoid displacement of copper by the metal within the accelerator solution. For example, for metallization of through-holes in circuit board manufacture, it is desirable to use a weakly acidic, neutral or weakly basic accelerator solution to avoid displacement of the copper cladding by the metal in the accelerator. To obtain a low acid noble metal accelerator solution, a suitable salt would include an alkali metal double halide salt of the noble metal such as the potassium salt of palladium tetrachloride. An aqueous solution of this salt could have a pH varying between about 3.0 and 6.0. Alkaline solutions may be made with complexed noble metal salts.

The metal content of the accelerator solution should be an amount at least sufficient to react with the stannous tin on the surface of the catalyzed part to be plated. Preferably, the metal content of the accelerator solution varies between 0.0001 and 0.1 moles per liter, and more preferably, varies between about 0.001 and 0.5 moles per liter.

A part is treated with the accelerator of the invention in the same manner as a catalyzed part is treated with a prior art accelerator. The catalyzed part is contacted with the accelerator for a time and at a temperature sufficient to cause reduction of the accelerating metal by the tin. Contact with the accelerator may be, for example, by immersion of the part in the accelerator solution, by floating the part on the surface of the accelerator solution or by spraying the accelerator solution onto the surface of the part to be plated. Treatment time may vary from about 30 seconds to about 10 minutes and preferably varies from about 1 to 5 minutes. The accelerator solution may be used cold or heated, preferably at a temperature varying from room temperature to 120° F. and most preferably at room temperature since reduction is believed to be thermodynamically possible at the lower temperatures.

In an alternative embodiment of the invention, a catalyzed part may be treated with a conventional accelerator followed by the accelerator of this invention. Further improvements are realized by this dual treatment but the advantages may be outweighed by the additional costs involved by the additional processing step.

Following acceleration of the catalyzed part as discussed above, the part may be metal plated in conventional manner. In an electroless metal plating process, plating occurs by contact of an electrolessly depositable metal with a catalytically active surface by chemical reduction in the absence of an external electric current. Processes and compositions for electroless deposition of metal are known in the art and are in substantial commercial use. They are disclosed in a number of prior art patents, for example, copper plating solutions are disclosed in U.S. Pat. Nos. 3,615,732; 3,615,733; 3,728,137; 3,846,138; 4,229,218; and 4,453,904, all incorporated herein by reference. Electroless nickel plating solutions are described in U.S. Pat. Nos. 2,690,401; 2,690,402; 2,762,723; 3,420,680; 3,515,564; and 4,467,067, all incorporated herein by reference. A large number of copper and nickel plating solutions are commercially available. Other metals that may be electrolessly deposited include gold, palladium and cobalt. Various alloys, such as copper and nickel alloys and copper or nickel alloys with boron or phosphorus are also capable of electroless metal deposition. The preferred electroless metals for purposes of this invention are copper and nickel.

Known electroless metal deposition solutions generally comprise four ingredients dissolved in water. They are (1) a source of metal ions, usually a metal salt such as copper or nickel sulfate, (2) a reducing agent such as formaldehyde for copper solutions, hypophosphite or dimethylamineborane for nickel solutions, (3) a pH adjustor such a hydroxide for copper solutions or an acid for nickel solutions and (4) one or more complexing agents for the metal sufficient to prevent its precipitation from solution. Other additives are typically contained in such plating solutions such as stabilizers, exaltants, grain refiners, brighteners, etc.

Plating by electrolytic deposition is in accordance with the above cited U.S. Pat. Nos. 3,099,608 or 4,895,739 or U.K. Patent No. 2,123,036B, also incorporated herein by reference. The part may first be treated with a chalcogen solution to form a chalcogenide of the catalytic metal believed to increase conductivity of the part. The part to be plated is then used as a cathode in a conventional electroplating cell, with or without the chalcogen treatment. Current density is conventional and varies typically within a range of from 5 to 25 amps per $ft^2$ but may be as high as from 30 to 80 amps per $ft^2$ for high speed solutions. The plating solution is maintained at a temperature ranging between room temperature and about 100° F. Plating is continued for a time sufficient to form a deposit of desired thickness. Suitable plating solutions are disclosed in U.S. Pat. No. 4,895,739. A step of treatment with a chalcogenide as disclosed in said U.S. Pat. No. 4,895,739 may be employed if desired dependent upon the use of the part to be plated. Copper and nickel are preferred plating metals.

The use of the accelerator of this invention shortens the time required to initiate deposition of metal on a catalyzed surface and completely cover the same. In addition, the metal deposit formed by the process of this invention is surprisingly found to be finer grained and smoother. In processes involving fine-line imaging and selective metal deposition, use of the catalyst of the invention provides metal images with enhanced edge acuity.

The invention will be better understood by reference to the examples that follow.

EXAMPLES 1 AND 2

In these examples, the process of the invention was compared to a prior art process. The process was used to plate an unclad epoxy circuit board base material using the following process steps:

| | |
|---|---|
| Step A | Immerse part in Cataposit$^R$ 44 catalyst (6%), a proprietary tin palladium colloidal electroless plating catalyst, at room temperature for 5 minutes; |
| Step B | Immerse part in accelerator identified below at room temperature for 4 minutes; |
| Step C | Immerse part in distilled water at room temperature for 2 minutes; |
| Step D | Immerse part in Niposit$^R$468 electroless nickel (100%), a proprietary electroless nickel plating solution, at room temperature for 10 minutes; |

The accelerator solutions used were as follows:

| Example 1 accelerator | |
|---|---|
| Palladium Chloride | 0.1 gram |
| Hydrochloric Acid | 20.0 ml |
| Water | to 1 liter |
| **Example 2 accelerator** | |
| Accelerator 240 solution from Shipley Company Inc. which is a proprietary accelerator solution free of metallic additives more noble than tin and containing alkali metal salts chloride and nitrate salts. | |

In the above process, the part was water rinsed in Example 2 between the steps of catalysis and acceleration to prevent accelerator contamination.

Figure 2:
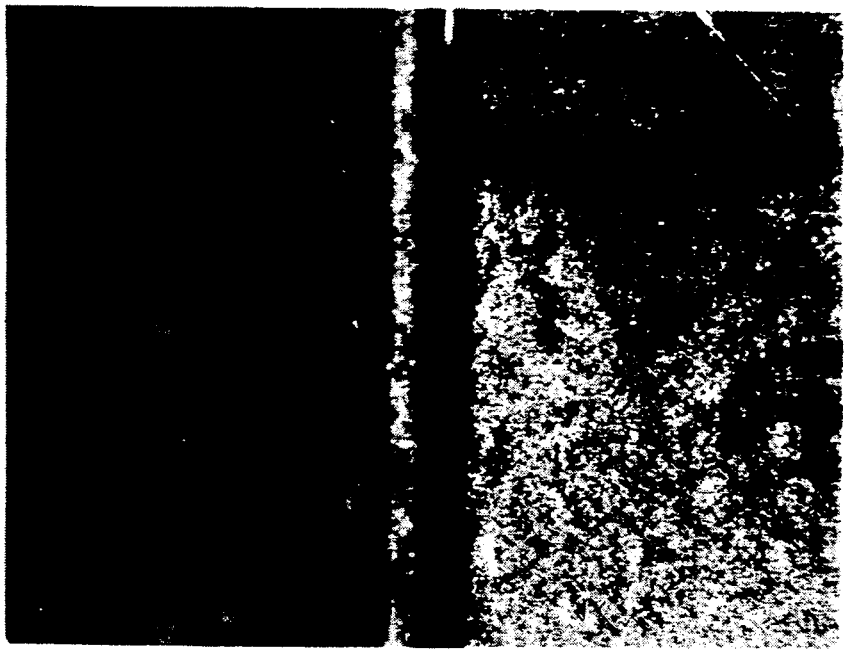
FIG. 2 is a photograph at a 40 magnification showing a nickel deposit on a different part of a test panel obtained using a process of the invention compared to a process of the prior art.
Figure 3:
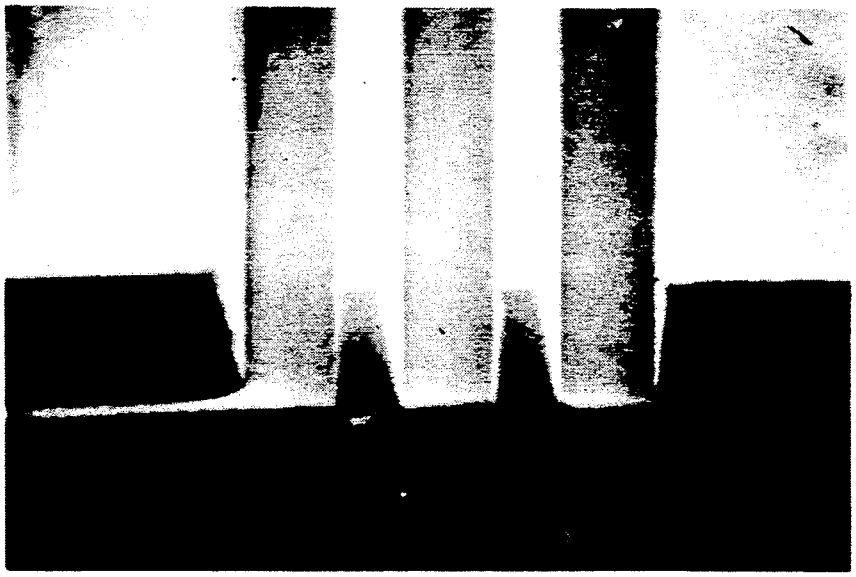
FIGS. 3, 4, 5 are photomicrographs of a deposit obtained using photomicrolithographic procedures and the process of the invention.
Figure 4:
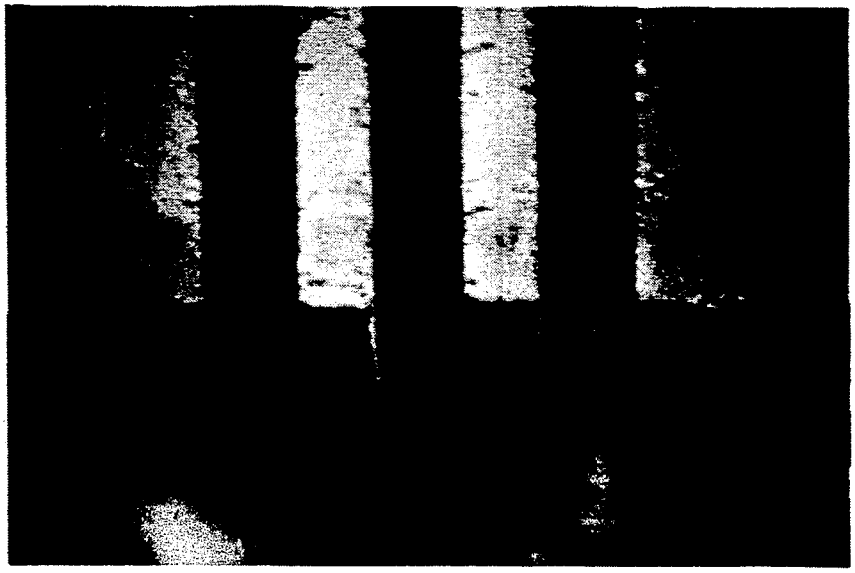
Figure 5:
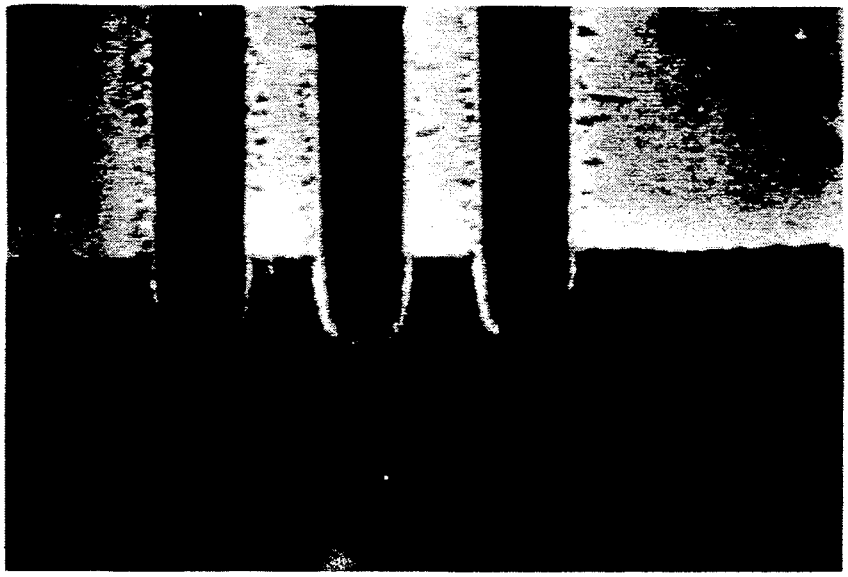

The nickel deposit obtained from the process of Example 1 had a fine grain structure and was smooth in appearance. The deposit from example 2 had a rougher grain with an uneven thickness. The differences in the deposit are shown in the drawings where the left side of FIG. 1 shows the deposit from Example 1 (using the palladium chloride accelerator) and the right side of FIG. 1 shows the deposit from Example 2. FIG. 2 is similar to FIG. 1, but taken from a different portion of the test panel. Both photographs were taken at a 40 X magnification.

EXAMPLE 3

The procedure of Example 1 was repeated except that in step D, an Electroposit ® 800 copper electoplating solution was substituted for the Niposit 468 electroless nickel solution and plating was conducted at room temperature at between 2 and 3 volts and between 3 and 3.5 amperes for 30 minutes. Plating occurred on 4 separate parts but not all parts were completely covered.

EXAMPLES 4 TO 10

The following examples illustrate the use of accelerators of the invention using metals other than palladium. The process was used to plate an unclad epoxy circuit board base material using the following process steps:

| | |
|---|---|
| Step A | Immerse part in Cataposit$^R$ 44 catalyst (6%), a proprietary tin palladium colloidal electroless plating catalyst, at room temperature (examples 6 and 7) or 102° F. (remaining examples) for 10 minutes and water rinse; |
| Step B | Immerse part in accelerator identified below at room temperature for 4 minutes; |
| Step C | Immerse part in distilled water at room temperature for 2 minutes; |
| Step D | Immerse part in Cuposit$^R$328 electroless copper (100%), a proprietary electroless copper plating solution, at room temperature for a time sufficient to obtain complete coverage. |

The accelerator solutions used all contained 1 gram per liter of a metallic salt as defined below dissolved in 1 liter of water acidified with 20 ml of hydrochloric acid to assist in dissolving the metallic salt except for an accelerator solution using silver nitrate which did not require acid for dissolution of the salt.

The metal salt of the accelerator and the results obtained in terms of take off time to initiate deposition and time to complete coverage of a part are set forth below.

| Example No. | Accelerator | Initiation Time (sec) | Time for 100% Coverage (sec) |
|---|---|---|---|
| 4 | Cobalt chloride | 75 | 105 |
| 5 | Cupric chloride | 60 | 105 |
| 6 | Manganese chloride | 30 | 90 |
| 7 | Nickel chloride | 30 | 60 |
| 8 | Silver nitrate | 40 | 180 |
| 9 | Palladium chloride | 30 | 40 |
| 10 | Accelerator 240 | 15 | 80 |

In the above examples, the palladium chloride accelerator was used in a concentration of 0.1 grams per liter. Though Accelerator 240 provided a faster initiation rate, the deposit quality obtained using the other accelerators was superior to that obtained using Accelerator 240.

EXAMPLE 11

This example represents the most preferred embodiment of the invention for use in the manufacture of printed circuit boards.

The procedure of Examples 4 through 10 was repeated using an accelerator that was a double salt of potassium and palladium chloride. The double salt was formed by the reaction of two moles of potassium chloride and one mole of palladium chloride in hydrochloric acid solution. The accelerator was made at a concentration of 0.1 grams of palladium in a solution having a pH of 4.7. Initiation time for plating was 15 seconds with complete coverage occurring in 35 seconds. Again, a fine grained deposit structure was observed. This accelerator would exhibit minimal displacement of copper in printed circuit board manufacture because of the high pH of the accelerator solution.

EXAMPLE 12

This example demonstrates a microlithographic process for metallizing an image in semiconductor manufacture utilizing a surface imaging process.

Silicon wafers primed with hexamethyldisilizane were spin coated with a positive Microposit ® S-1813 photoresist to form a film having a thickness of 1.2 microns following drying. The coated substrates were exposed to patterned radiation using a GCA DSW wafer stepper to expose successive portions under conditions known to give full exposure, namely an energy level of approximately 100 mJ/cm$^2$ with appropriate depth of focus. To form a pattern, the radiation was passed through a GCA resolution reticle mask. The wafer was then treated in the following manner, all steps being carried out at 20° C. using filtered solutions:

1) Cataposit® 44 Catalyst [tin-palladium colloid in hydrochloric acid], 4 minutes, with agitation;
2) Accelerator—0.1 gm/l $PdCl_2$ in 2% HCl solution, 3 minutes;
3) Rinse with deionized water, 2 minutes;
4) Microposit® developer (1:1), 1 minute, with paddle agitation;
5) Rinse with deionized water, 2 minutes;
6) Niposit® 468 electroless nickel (5%), time variable, with no agitation.

The results obtained are shown in FIGS. 3 through 6 of the drawings which show the deposit after plating 5 minutes, 8 minutes and 15 minutes respectively. It can be seen that at 8 minutes, some nodules are visible on the line edges. Nodular growth increased at 15 minutes.

Figure 6:
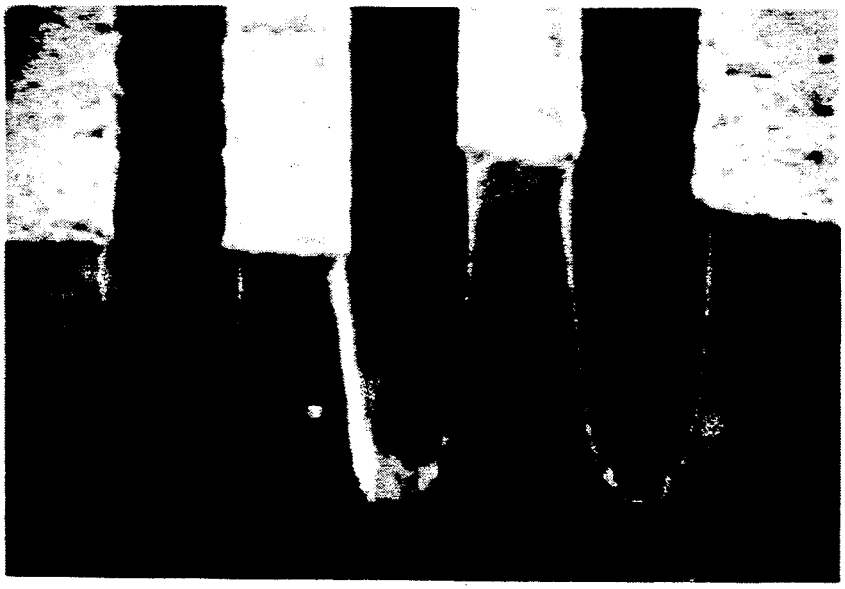
FIG. 6 is a photomicrograph of a deposit obtained using photomicrolithographic procedures and a process with a prior art accelerator.

The procedure described above was repeated but Accelerator 240 solution (as described above) was substituted for the palladium chloride accelerator and a 10 percent nickel solution was used with the results shown in FIG. 6 of the drawings. The thickness of the deposit shown in FIG. 6 is about equivalent to the thickness of the deposit shown in FIG. 4. The deposit obtained using the prior art accelerator is seen to be significantly more grainy than that obtained with the accelerator of the invention.

We claim:

1. A process for plating a substrate with metal, said process comprising the steps of:

a. catalyzing said substrate with a preformed metal plating catalyst that is the product of reaction of stannous ions and ions of a metal catalytic to electroless metal deposition, b. directly accelerating said catalyzed substrate by contact of the same with an accelerating solution that is aqueous stannous tin free solution of a metal that does not impede a plating reaction and which is more noble in the electromotive series than tin, said step of acceleration being performed without a step of water rinsing between the step of catalyzing and acceleration, and c. plating metal over said treated substrate.

2. The process of claim 1 where the noble metal salt is palladium.

3. The process of claim 1 where plating is by electroless metal deposition.

4. The process of claim 1 where plating is by electrolytic metal deposition.

5. The process of claim 1 where plating is by electroless metal deposition followed by electrolytic metal deposition.

6. The process of claim 4 where the catalyzed substrate is treated with a solution of a chalcogen subsequent to catalysis and prior to electrolytic metal deposition.

7. The process of claim 6 where the chalcogen is sulfur.

8. The process of claim 1 where the metal in the accelerating solution is a noble metal.

9. The process of claim 7 where the accelerating solution is acidic.

10. The process of claim 9 where the pH is below the pH where hydroxide formation of the metal salt in the accelerator solution will occur.

11. The process of claim 7 where the metal in the accelerating solution is the same metal as in the plating catalyst.

12. The process of claim 7 where the noble metal of the catalyst and the accelerating solution is palladium.

13. The process of claim 12 where the palladium in the accelerating solution is a double salt of a palladium halide having a pH in excess of 3.

14. The process of claim 12 where the palladium is present in an amount of at least 0.0001 moles per liter of solution.

15. The process of claim 12 where the palladium is present in an amount ranging between 0.001 and 0.05 moles per liter of solution.

16. The process of claim 7 where the accelerating solution is an aqueous solution of a salt of the accelerating metal.

17. The process of claim 15 where the substrate is a copper clad printed circuit board substrate.

18. A process for increasing the density of catalytic metal sites over the surface of a substrate, said process comprising the steps of contacting said substrate with a preformed product of reaction of a stannous salt and a noble metal salt followed by contact of the so treated substrate with an ionic stannous tin free solution of a metal salt more noble than the noble metal of the noble metal stannous salt reaction product, said process being conducted in the absence of an intermediate water rinsing step.

19. The process of claim 18 where the noble metal salt in the ionic solution is a palladium salt.

20. The process of claim 19 where the palladium salt is a double salt of palladium chloride and the solution has a pH in excess of 3.

21. The process of claim 20 where the substrate is a copper clad circuit board base material.

22. The process of claim 18 where the ionic solution is acidic.

23. The process of claim 18 where the pH is below the pH where hydroxide formation of the noble metal salt in the ionic solution will occur.

24. The process of claim 18 where the noble metal on the surface of the substrate and in the ionic solution is palladium.

25. The process of claim 24 where the palladium in the ionic solution is present in an amount of at least 0.0001 moles per liter of solution.

26. The process of claim 25 where the palladium is present in an amount ranging between 0.001 and 0.05 moles per liter of solution.

27. The process of claim 18 where the substrate is a substrate inert to metal deposition.

28. The process of claim 18 where the admixture of said stannous salt and said palladium salt is a tin-palladium colloid.

29. The process of claim 18 where the substrate is a printed circuit board substrate.

30. The process of claim 18 where the substrate is a semiconductor having a coating of an imaged photoresist.

* * * * *